United States Patent [19]

Hwa

[11] 3,940,282

[45] Feb. 24, 1976

[54] BLADE CLEANING OF SURFACES WITH REVERSE MOVEMENT

[75] Inventor: Stephen C. P. Hwa, Penfield, N.Y.

[73] Assignee: Xerox Corporation, Stamford, Conn.

[22] Filed: June 24, 1974

[21] Appl. No.: 482,716

[30] Foreign Application Priority Data

June 29, 1973 United Kingdom ..... 31046/73

[52] U.S. Cl. ..... 134/6; 15/256.5; 15/256.51; 15/256.53; 355/15

[51] Int. Cl.[2] ..... B08B 1/02

[58] Field of Search ..... 134/6; 15/256.5, 256.51, 15/256.53; 355/15

[56] References Cited

UNITED STATES PATENTS

| | | | |
|---|---|---|---|
| 3,006,788 | 10/1961 | Krohm | 134/6 |
| 3,552,850 | 1/1971 | Royka et al. | 355/15 |
| 3,711,796 | 1/1973 | Saito et al. | 355/15 |
| 3,811,914 | 5/1974 | Saito et al. | 355/10 X |
| 3,843,407 | 10/1974 | Thorp | 134/6 |

FOREIGN PATENTS OR APPLICATIONS

| | | | |
|---|---|---|---|
| 2,111,509 | 9/1971 | Germany | 355/15 |

*Primary Examiner*—S. Leon Bashore
*Assistant Examiner*—Marc L. Caroff
*Attorney, Agent, or Firm*—James J. Ralabate; Donald C. Kolasch; Ernest F. Chapman

[57] ABSTRACT

Liquid developer is removed from support surfaces, such as reusable surfaces used for carrying latent electrostatic images, by blades with relative motion between the surface and the blades. Spreading of the liquid developer upon the cleaned portion of the surface during rest periods is prevented by reversing the relative motion between blade and surface and moving the blade away from the surface before each rest period.

5 Claims, 2 Drawing Figures

BLADE CLEANING OF SURFACES WITH REVERSE MOVEMENT

BACKGROUND OF THE INVENTION

This invention relates to cleaning material from a support surface, and more particularly, it relates to an apparatus and method for removing liquid developer from a photoconductive or other surface.

In the development of electrostatic latent images where liquid developers are used to develop the image on the reusable photoconductor surface or on a reusable interposition surface, liquid developer remains on the surface after the developer image is transferred to a substrate. In these processes and apparatuses where the surface is reused to develop subsequent images, the residual liquid developer must be removed therefrom to such an extent that the residual developer will not interfere with subsequent imaging causing streaks and other image or non-image patterns and smudges of developer which transfer to subsequent substrates. In order to accomplish sufficient removal of the residual developer so that streaking and smudging of subsequent prints is eliminated, several prior art methods have been attempted, but they have resulted in failure. Wiper blades are commonly used to remove the residual liquid developers from these and other support surfaces.

U.S. Pat. No. 3,660,863 issued to Gerbasi on May 9, 1972, discloses a scraper blade acting on a xerographic drum for removing particulate toner material from the drum. In Gerbasi, the cutting edge of the blade, that is, the edge of the blade formed by the upper face surface or top surface and the front side surface, is positioned slightly below the horizontal center line of the drum and the cutting edge is held in a manner to readily cut or chisel the particulate toner material from the drum surface. This configuration is suitable for particulate toner material, however, when used for cleaning liquid developers from a support surface, problems are encountered in disposing of the liquid cleaned from the surface when the relative motion between the blade and the surface ceases. The liquid passes between the blade and surface at zero relative speeds. This leaves developer on the cleaned support surface which prints out when operation of the machine is resumed.

Blade cleaning is also described by Royka et al, in U.S. Pat. No. 3,552,850 wherein at least one self-adjusting flexible cleaning blade for pressure contact cleaning of the imaging surface is shown. In Royka et al, the leading edge of at least one cleaning blade is preferably positioned to form an acute angle of less than about 90° and greater than about 20° with the confronting portion of the imaging surface or plane tangent to the imaging surface at the line of blade contact to clean particulate toner from photoconductive members when means to supply a dry solid lubricant to the imaging surface are provided. This cleaning technique which is primarily a wiping action, is operable for particulate toner, but when liquid developers are used, streaking of the support surface with developer due to the interference of the intimate contact between the wiper blades and the support surface from debris, remains a problem. Furthermore, the wiping action does not suitably remove the liquid developers from the surface. Difficulties are also encountered with cleaning systems of this type using a blade which engages the surface to be cleaned when the relative motion between the blade and the surface ceases. Although the blade acts to clean substantially all the material from the surface while there is relative motion between them above a given value, it has been found that liquids will pass between the blade and the surface, possibly by capillary action at small or zero relative speeds. Furthermore if the blade is removed from engagement with the surface, a bead of liquid which has piled up against the table will spread out beyond the blade position when the blade is removed.

Thus, the liquid material will spread on the surface over a small region immediately downstream of the blade, and if the surface passes to further processing stations when the relative motion is resumed, the remaining developer material will not be cleaned off by the blades and will contaminate those further stations.

In accordance with the present invention, cleaning blades may be designated as scraper blades or wiper blades. A scraper blade is defined as one wherein the stem extends towards the tip in the upstream direction of the drum's movement and when pressed against the drum exerts a chiselling action on the material (liquid developer and debris) on the drum surface.

A blade which in operation is pressed against a support surface so that it is bent along its length in the downstream direction of the drum motion has a wiping action as it tends to be lifted up by material moving with the drum surface. A wiper blade is defined in accordance with the present invention as one in which the stem extends in the downstream direction of the drum motion. As used herein, upstream and downstream refer to drum motion.

OBJECTS OF THE INVENTION

It is an object of this invention to provide an apparatus and method for improving the cleaning of reusable surfaces used in electrostatic copying machines employing liquid developers for development of the image.

Another object of this invention is to provide an apparatus and method to improve the removal of liquid developer from reusable surfaces when scraper blades and/or blades are used as the cleaning blade.

It is another object of this invention to provide a method and apparatus to prevent the spreading of liquid developer over a region downstream of cleaning blades where the relative motion between the reusable support surface and the blades ceases.

Still another object of this invention is to provide a method and apparatus to prevent the contamination of processing stations downstream of the cleaning blade with liquid developer when relative motion between the blade and the support surface is resumed after a rest period.

SUMMARY OF THE INVENTION

These and other objects are accomplished by providing a method of cleaning liquid materials (liquid developer) including debris such as lint, paper fibers, dust and the like, from a surface by intermittently moving a support surface in one direction relative to the support and in engagement therewith with rest periods between periods of relative motion in said one direction, and before each such rest period reversing the relative motion between the blade and the surface with the blade still in engagement with the surface. The cleaning blade may then be moved away from the support surface after reversing the relative motion.

According to another aspect of the invention there is provided an electrostatographic reproduction method comprising forming a latent electrostatic image on a moving support surface, for example, a photoconductive surface, developing the latent image with liquid developer, transferring the developed image on to support material and cleaning the liquid developer and debris remaining on the support surface by wiper and/or scraper blades. The surface is intermittently moved relative to the wiper and/or scraper blades in engagement therewith with rest periods between periods of relative motion in one direction, and before each such rest period reversing the relative motion between the blade and the surface with the blade still in engagement with the surface.

According to a further aspect of the invention, there is provided an electrostatographic reproduction apparatus comprising a movable support surface, means for forming a latent electrostatic image on said surface, means for applying liquid developer to said latent image to develop the image, means to transfer the developed image to a sheet of support material and cleaning means to clean material remaining on the support surface after transfer, a drive mechanism to move the support surface past said means in succession, and means to stop the drive mechanism for a rest period when required and to reverse the drive mechanism before each rest period.

The reversal of the motion ensures that the region immediately upstream of the blade contains no liquid material so that there will be substantially no creeping or spreading of liquid developer under the blade during the rest period. When the original relative motion is resumed, the blade continues its cleaning action, and no liquid material by-passes the blade to contaminate succeeding processing stations.

Additional objects of this invention will become apparent to those versed in the art of electrostatic copying machines in view of the following detailed description of the method and apparatus taken in conjunction with the accompanying drawings in which preferred embodiments of the apparatus are shown.

DESCRIPTION OF THE PREFERRED EMBODIMENTS

Figure 1:
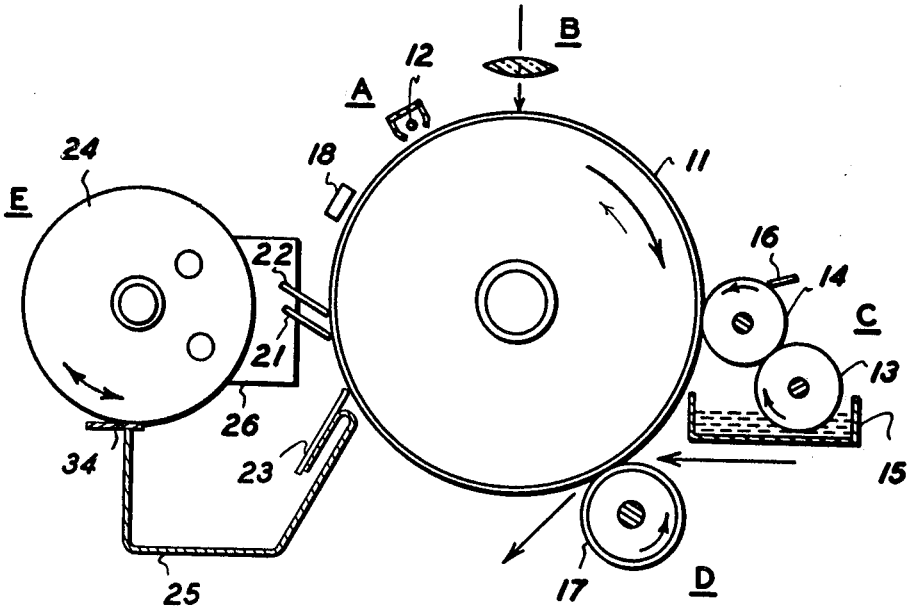
FIG. 1 shows a typical example in the form of a schematic sectional view of an electrostatographic reproduction apparatus having dual scraper blades and a single wiper blade capable of being withdrawn from or moved away from the drum.
Figure 2:
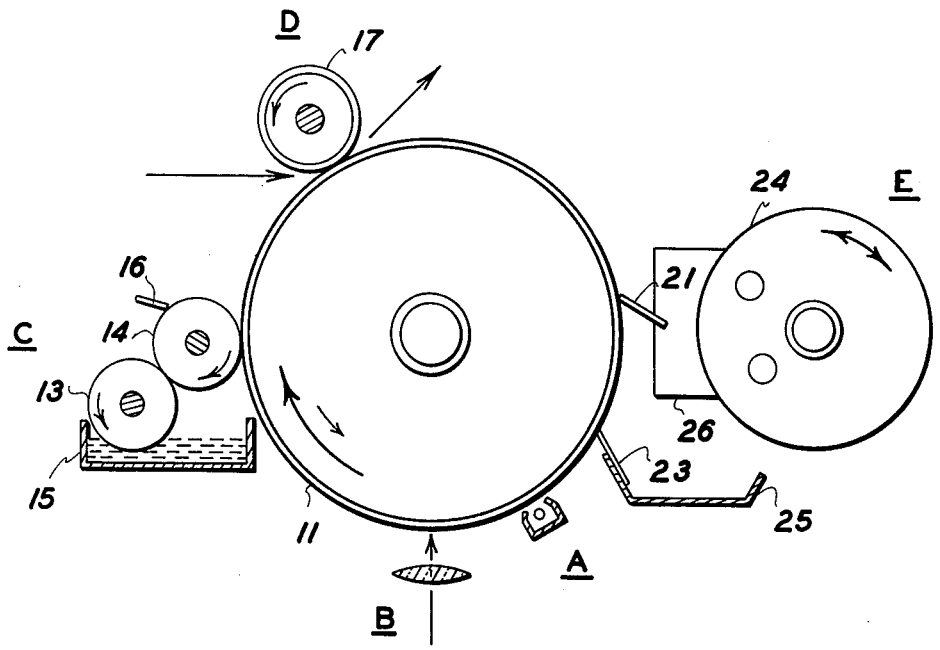
FIG. 2 shows a schematic sectional view of an electrostatographic reproduction apparatus having a single scraper blade, the scraper blade being capable of withdrawal from the drum which it engages.

In the copying apparatus illustrated in FIGS. 1 and 2 a copying drum 11 having a photoconductive surface is rotated in the direction of the large arrow about its axis past a number of processing stations. The copying cycle starts at the charging station A wherein a corona discharge device 12 is energized to a high potential to apply charge to the drum surface. The drum then passes to the exposure station B at which a flowing image of a document is projected onto the charged drum surface by an optical system (not shown) to produce an electrostatic latent image. The image flows so that it moves in synchronism with the moving drum surface. The latent image passes to the development station C at which liquid developer is applied from a reservoir 15 by means of rolls 13 and 14. The roll 13 is a supply roll whose lower portion dips into the liquid in the reservoir 15 and whose upper portion is spaced by (for example) 0.25 mm from the upper roll 14 which has its surface shaped with a helical groove. The roll 14 is provided with a flexible doctor blade 16 which removes liquid from the groove to below the groove upper edges due to the deformation of the blade into the groove. The developer is attracted by electrostatic attraction from the remote part of the groove to the latent image across the gap between them to develop the image. An example of this method of development is described in detail in U.S. Pat. No. 3,084,043 issued to Robert W. Gundlach, which is incorporated herein by reference, wherein there is claimed a method of development in xerography comprising positioning close but spaced from an electrostatic latent image on an image bearing surface a substantially continuous film of electrically conductive ink comprising a homogeneous liquid solution, providing flow aiding elements in physical contact between said ink and said image bearing surface, and applying a bias to said ink whereby ink moves along said flow aiding elements and develops said electrostatic latent image.

A sheet of paper is fed to a transfer station D by sheet feed apparatus (not shown) to move in synchronism with the drum and is pressed against the drum surface by a transfer roll 17 so that the developed image is transferred to the paper which is then conveyed away from the transfer station through a chute (not shown). Any material remaining on the drum after the transfer station must now be cleaned off at the cleaning station E. After cleaning, electroluminescent strip 18 floods the drum surface with light to discharge any remaining charges, so that the drum can pass onto the charging station for the beginning of the next cycle. A drive mechanism to move the support surface past the various stations in succession and to move various other rolls is not shown. Means to move these various surfaces can be readily provided by one skilled in the art.

At the cleaning station in FIG. 1, there are provided two scraper blades 21 and 22. The scraper blades are mounted on supporting block 24 which can be moved so that the scraper blades engage or disengage drum 11. The arrows in block 24 in the drawing indicate that the block may be rotated to engage or disengage the scraper blades and the support surface as desired. If the blades are left pressing hard against the stationary drum, the photoconductive surface may be deformed, and the blades may acquire a permanent set.

In FIG. 1, there is illustrated wiper blade 23 mounted on one edge of sump 25 located below the scraper blades and the wiper blade to catch liquid developer which drips from the blades. As illustrated in FIG. 1, the edge of sump 25 opposite the edge upon which wiper blade 23 is mounted, is supported by supporting block 24 at point 34 so that the engagement or disengagement of wiper blade 23 with the support surface is controlled by the movement of supporting block 24. Thus, means are provided for simultaneously moving the scraper blade or scraper blades and the wiper blade out of engagement with the support surface, or in the alternative for moving said blades into engagement with said support surface. When wiper blade 23 causes liquid developer to flow upstream on drum 11 in the direction of transfer station D, it is preferred that sump 25 extend to the bottom center of the support surface on drum 11 (not shown in FIG. 1).

Embodiments operable in accordance with the present invention relative to the embodiment of FIG. 1, but not shown include those having no wiper blade 23 and/or only one scraper blade 21. Further, in accordance with a preferred mode of the present invention (not shown) supporting block 24 need not be movable to disengage the blades from the surface of drum 11. Further, in another preferred mode of the present invention the edge of sump 25 opposite the edge upon which wiper blade 23 is mounted need not be supported by supporting block 24 at point 34 and independent means for mounting said sump and said wiper blades may be provided by one skilled in the art. One skilled in the art can also provide other suitable means for mounting the scraper blade being capable of engagement with the surface of drum 11.

The scraper blades 21 and 22 are preferably moved away from the drum surface at the beginning of a rest period when the drum is stationary so as to prevent deformation of the photoconductive material. When this movement takes place, the bead present at the end surface will be left on the drum surface and will tend to spread out on that surface. When the scraper blades are moved back into operative position, some of the bead material will have spread to downstream (upwards in FIG. 1) of the final scraper blade and this material will then contaminate the succeeding processing stations. Even when the scraper blades remain engaged with the surface of drum 11 during the rest periods (periods when relative motion between drum and blade is zero), there is a tendency of the bead of liquid developer at the blade to spread out or creep on the surface under the blade.

This contamination is evidenced by a black line or strip on the first copy produced in a new copy run, formed by developer which has spread under the scraper blade during the preceding rest period.

This problem is overcome in accordance with the present invention by reversing drum 11 a short distance (shown by the small arrow in the drawings) with the blades still in contact with the surface of drum 11 prior to the beginning of the rest period. This may be accomplished by any manual or automatic means to reverse the drive mechanism of the drum. For example, programmer means may be used to accomplish the reversal of drum movement.

The programmer which controls the operation of the processing stations and the drive to the drum is arranged to cause the drum to reverse a short distance with the blades still in contact before the rest period begins. The blades are thereby wiped of excess ink and trapped fibers and dust are released. The spread of the bead during the rest period is thus located totally upstream of the scraper blade so that when the blade is engaged with the drum surface again and rotation of the drum resumed, the whole original bead will be scraped off the drum surface. A reverse motion of 7 to 9 mm has been found sufficient. The blades are not only wiped of excess ink but the release of trapped debris such as lint, dust, paper fibers and the like, is also promoted.

In the embodiment of FIG. 1, it is possible to omit the wiper blade if the sump extends from below the scraper blade towards the bottom center of the drum. The bead formed at the end of the scraper blade will then drop into the sump directly or flow down the drum surface until it eventually drops from the surface. The sump may extend all the way to the bottom center of the drum if the paper conveyor apparatus can be suitably arranged, or it may be acceptable for any drops from the lowest region of the drum to be lost in the apparatus, the sump extending only partially towards bottom center. There will be very few such drops, because when the drum is in motion, the upward movement of the drum surface will oppose the downward flow of the drops, and they will tend to drop from the surface before they reach bottom center. Only when the drum is stationary will the drops flow further down the drum, and such drops are only supplied with the small amount of material from the bead present at the scraper blade and that on the portion of the drum surface between the blade and the developer station when the drum stops.

In FIG. 1, the drum is arranged with the transfer station at the bottom of the drum and the cleaning station E acting on the upwardly moving surface of the drum. FIG. 2 shows an alternative arrangement with the transfer station at the top of the drum, and the cleaning station acting on the downwardly moving surface of the drum. In this arrangement (FIG. 2) there is no wiper blade in trailing relationship to the moving surface, but instead a blade (23) similar to the wiper blade of FIG. 1 is mounted below single scraper blade 21 in approximately the same orientation as the scraper blade relative to the drum. Blade 23 in FIG. 2 is only lightly pressed on to the drum surface and serves to deflect any droplets on the drum surface into sump 25. Some droplets from scraper blade 21 pass over the upper surface of that blade and drip into sump 25 directly.

The embodiment of FIG. 1 shows two scraper blades, whereas the embodiment of FIG. 2 shows a single scraper blade. It is of course possible for the embodiment of FIG. 1 to be modified to have a single blade, and for the embodiment of FIG. 2 to be modified to have a pair of scraper blades.

As used in this invention the distinction between scraper blade and wiper blade set out supra in the background of the invention is critical.

At the cleaning station in FIG. 2, there is provided scraper blade 21. The scraper blade is mounted on supporting block 24 which can be moved so that scraper blade 21 can be disengaged from drum 11 when the blade is not in use. The arrows in supporting block 24 in FIG. 2 indicate that it may be rotated to engage or disengage the scraper blade and the support surface as desired. If the blade 21 is left pressing hard against the stationary drum 11, the photoconductive surface may be deformed and the blade may acquire a permanent set as discussed relative to the blades of FIG. 1 supra.

In FIG. 2, blade 23 mounted on sump 25 is positioned so that it lightly engages drum 11. As illustrated in FIG. 2, blade 23 permanently engages drum 11, however, blade 23 may be suitably mounted to disengage from drum 11 as desired (not shown) in FIG. 2. In the embodiment shown in FIG. 2, blade 23 is mounted in sump 25. Sump 25 is located below the scraper blade and blade 23 to catch the liquid from the blades.

In addition to providing a method of preventing liquid developer and debris from passing upstream of the wiper blades, the dual scraper blade components illustrated in FIG. 1, wherein a second scraper blade is located downstream from the first scraper blade, provide a method of removing streaks of liquid developer from the support surface which remain on the support surface upstream of the first scraper blade due to the solid debris entrained between the first scraper blade and the support surface. This action is described in my copending applications.

The developer liquid remaining on the drum after the transfer station D, together with any foreign matter such as paper fibers reaches the wiper blade 23 first in FIG. 1. The characteristics of the wiper blade 23 are such that most of the material passes under the blade unaffected.

The scraper blades 21 and 22 in FIG. 1 and 21 in FIG. 2 scrape the material from the drum 11 forming a bead at the end surface of each blade. When this bead reaches a certain size, it will fall into the sump or flow down the surface of the drum to blade 23 which then deflects the flowing material into the sump 25.

Each scraper blade is preferably of polyurethane of 65 Shore A hardness, however, scraper blades having a hardness up to about 90 Shore A or higher are also within the scope of the invention. The scraper blades are preferably about ¾ inch long and 80 thousandths of an inch thick. The blades are clamped in a supporting block 24 preferably over about the first third or their length. The ends of the blades are at 90°. A much smaller angle (such as 60°) at the cutting edge leads to failure by the edge becoming tucked under the blade by friction. The holder of the blades extends at 20° ± 5° to the tangent to the drum at the point of contact (a wider variation of angle being possible to suit different combinations of blades, liquids and drum surfaces), the blade preferably being slightly flexed against the drum in operation by the supporting block 24, with a force of the order of 10 grams per centimeter. In accordance with the present invention, it is preferred that the scraper blades have a rectangular longitudinal cross section.

Wiper blade 23 is preferably a 125 um blade, for example, of polyethylene terephthalate, only very slightly flexed against the support surface of drum 11. Suitable wiper blade materials, sizes and position angles may be chosen by one skilled in the art. Suitable non-metallic flexible cleaning blade materials are described by Royka et al in U.S. Pat. No. 3,552,850 at Column 14. Stiffener plates and other improvements known and described in the art can be used in mounting the wiper blades.

In the drawings the arrows in drum 11 are significant in that the large arrow indicates the direction of rotation of the drum during normal operation, that is, during the electrostatographic printing or copying cycle. The small arrow is indicative of the reversal cycle, preferably of about 7 mm to about 9mm, prior to the beginning of the rest cycle to prevent creeping or spreading of liquid developer over a region downstream of the cleaning (scraper and/or wiper) blades when the relative motion between the reusable support surface, e.g., a selenium photoconductive surface, and the blade or blades ceases.

In accordance with the stated objects, the present invention provides a suitable apparatus and method for cleaning liquid developer from a surface capable of carrying electrostatic latent images, and the removal of liquid developer from reusable surfaces is improved when the reversal motion mode is used just prior to any rest period. While this invention has been described with reference to the structures and method steps disclosed herein, it is not confined to the details set forth; and this application is intended to cover such modifications or changes as may come within the purposes of the improvements or the scope of the following claims.

What is claimed is:

1. A method of cleaning liquid developer from an imaging surface which is capable of carrying an electrostatic latent image comprising intermittently moving the imaging surface in one direction relative to a stationary cleaning blade in engagement therewith with rest periods between periods of relative motion in said one direction, and before each such rest period reversing the relative motion between the stationary cleaning blade and the surface with the blade still in engagement with the surface and moving the cleaning blade away from said surface after reversing said relative motion.

2. A method as set forth in claim 1 further comprising engaging the cleaning blade and the surface prior to resuming the relative motion between the blade and the surface.

3. A method in accordance with claim 1 wherein said cleaning blade comprises at least one scraper blade and at least one wiper blade in succession, said scraper blade being one in which the stem of the blade extends towards the tip of the blade in contact with the imaging surface in the upstream direction of motion of the surface being cleaned and said wiper blade being one which in operation is pressed against the surface being cleaned so that the blade is bent along its length in the downstream direction of the motion of the surface being cleaned.

4. A method in accordance with claim 3 further comprising moving said wiper and scraper blades away from said surface simultaneously after reversing said relative motion.

5. Electrostatographic reproduction method comprising forming a latent electrostatic image on a moving support surface, developing the latent image with liquid developer, transferring the developed image to a support material and cleaning the liquid developer remaining on the support surface by intermittently moving said support surface in one direction relative to at least one stationary cleaning blade in engagement therewith with rest periods between periods of relative motion in said one direction, and before each such rest period reversing the relative motion between the stationary cleaning blade and the surface with the blade still in engagement with the surface and moving the cleaning blade away from the surface after reversing said relative motion.

* * * * *